United States Patent [19]

Sasaki et al.

[11] Patent Number: 4,623,207

[45] Date of Patent: Nov. 18, 1986

[54] PRINTED CIRCUIT BOARD CONNECTOR

[75] Inventors: Masao Sasaki, Takasaki; Kazuo Wada, Isezaki; Jiro Tanuma, Takasaki, all of Japan

[73] Assignees: Oki Densen Kabushiki Kaisha, Kanagawa; Oki Electric Industry Company, Limited, Tokyo, both of Japan

[21] Appl. No.: 748,770

[22] Filed: Jun. 25, 1985

[30] Foreign Application Priority Data

Jun. 26, 1984 [JP] Japan ..... 59-94559[U]

[51] Int. Cl.[4] ..... H01R 9/09

[52] U.S. Cl. ..... 339/17 LM; 339/17 M; 339/176 MP

[58] Field of Search ..... 339/17 M, 17 LM, 176 MP, 339/204, 205

[56] References Cited

U.S. PATENT DOCUMENTS

| | | | |
|---|---|---|---|
| 3,123,800 | 3/1964 | Phelps et al. | 339/17 LM |
| 3,173,732 | 3/1965 | James | 339/176 MP |
| 3,858,961 | 1/1975 | Goodman et al. | 339/176 MP |
| 4,439,000 | 3/1984 | Kaufman et al. | 339/176 MP |

FOREIGN PATENT DOCUMENTS

| | | | |
|---|---|---|---|
| 3035054 | 4/1982 | Fed. Rep. of Germany | 339/17 LM |
| 57-95791 | 6/1982 | Japan . | |
| 57-51708 | 11/1982 | Japan . | |
| 58-27636 | 6/1983 | Japan . | |
| 58-47665 | 10/1983 | Japan . | |
| 59-14286 | 1/1984 | Japan . | |
| 59-14287 | 1/1984 | Japan . | |
| 1374671 | 11/1974 | United Kingdom . | |
| 1393771 | 5/1975 | United Kingdom . | |

*Primary Examiner*—John McQuade

*Attorney, Agent, or Firm*—Bachman & LaPointe

[57] ABSTRACT

To simplify both the printed circuit board connector structure itself and the circuit board connecting work, the improved circuit board connector comprises a connector body and plural roughly U-shaped spring contacts elastically housed within the connector body. Circuit boards to be connected are engageable with the board connector in card edge connection manner or in bolt-nut connection manner. The above board connector is simple in structure and in connecting operation so as to be available for an automatic mass-production assembly process line.

5 Claims, 6 Drawing Figures

PRINTED CIRCUIT BOARD CONNECTOR

BACKGROUND OF THE INVENTION

1. Field of the Invention

The present invention relates generally to a printed circuit board connector, and more specifically to a printed circuit board connector for connecting at least two printed circuit boards, which is particularly suitable, when used, for an automatic mass-production assembly process line.

2. Description of the Prior Art

As is well known, there are printed circuit board connectors of various kinds for connecting one circuit board to the other circuit board. Two circuit boards are connected to each other by connecting appropriately formed printed contact areas of a first board to those of a second board through the board connector. The conventional circuit board connector includes usually plural pairs of elastic leaf-spring contacts longitudinally arranged within a connector body. The spring contacts are fixed to the connector body by pressure fitting the spring contacts to round or square holes formed in the connector body or by molding the connector body together with the spring contacts previously arranged in a mold. Each spring contact has an elastically bent portion and a non-elastical straight portion. When connecting two boards, one end of a first circuit board is inserted into the board connector so that the elastically bent portions of the spring contacts are brought into pressure contact with the contact areas of the first board. On the other hand, the free ends of the non-elastical straight portions of the spring contacts are directly soldered to other contact areas of a second board to be connected to the first board.

In other words, the first board can be connected to the board connector only by inserting the board into the connector; however, the second board should be soldered to the spring contacts arranged in the board connector. Further, after soldering, the three elements of the first board, the second board, and the board connector should be fixed by the use of appropriate fastening members.

Therefore, there exist problems in that the assembling work of the board connector itself is complicated and therefore costly. Further, the connection work of two separate circuit boards via the board connector is also complicated and therefore costly. In particular, in connecting a number of circuit boards via prior-art board connectors in an automatic mass-production assembly process line, the above-mentioned drawbacks are serious.

The arrangement of the prior-art circuit board connector will be described in further detail hereinafter with reference to the attached drawings.

SUMMARY OF THE INVENTION

With these problems in mind, therefore, it is the primary object of the present invention to provide a printed circuit board connector which can readily be assembled and with which at least two circuit boards can readily be connected to each other.

To achieve the above-mentioned object, the printed circuit board connector according to the present invention comprises (a) a connector body formed with a plurality of spring contact housing partitions and at least four inner walls; and (b) a plurality of roughly U-shaped spring contacts housed within the spring contact housing partitions separately in such a way as to be loosely supported by the two inner walls in longitudinal non-elastic direction thereof but compressedly supported by the other two inner walls near a base of the spring contact in lateral elastic direction thereof to allow two free ends of the spring contact to be brought into contact with contact surfaces of two separate circuit boards, independently, when the two circuit boards are attached on both surfaces of the board connector, separately.

Further, the connector body is formed with at least one card edge connection portion or at least one pair of bolt holes and at least one pair of locating pins.

Therefore, when assembling the board connector, plural contact springs are simply inserted into the molded body. Further, when connecting circuit boards through the board connector, circuit boards can simply be connected to the board connector in card edge connection manner or in bolt-nut connection manner without depending upon soldering.

BRIEF DESCRIPTION OF THE DRAWINGS

The features and advantages of the printed circuit board connector according to the present invention over the prior art circuit board connector will be more clearly appreciated from the following description of the preferred embodiments of the invention taken in conjunction with the accompanying drawings in which like reference numerals designate the same or similar elements or portions throughout the figure thereof and in which.

DETAILED DESCRIPTION OF THE PREFERRED EMBODIMENTS

To facilitate understanding of the present invention, a brief reference will be made to an example of prior-art printed circuit board connector with reference to the attached drawing.

Figure 1:
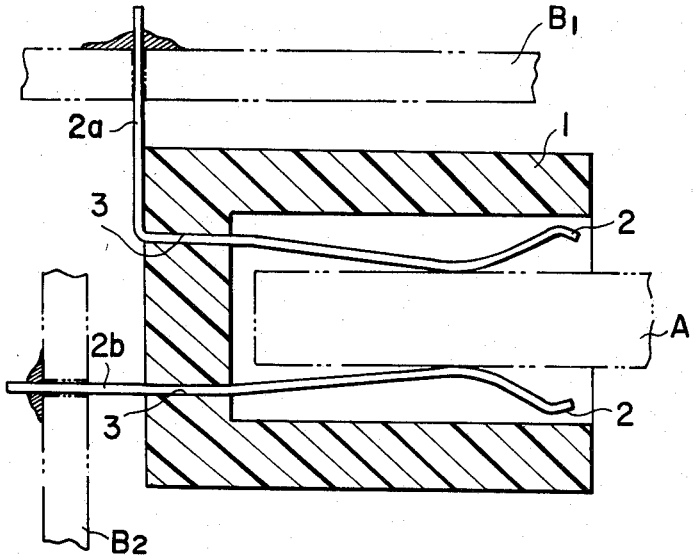
FIG. 1 (PRIOR ART)
FIG. 1 is a diagrammatical cross-sectional view showing an example of prior-art printed circuit board connectors.

In FIG. 1, the prior-art board connector includes a connector body 1 made of an insulation material such as resin and a number of spring contacts longitudinally arranged within the connector body 1.

The spring contacts 2 are fixed to the body 1 by pressure fitting the arranged spring contacts 2 through holes 3 formed in the bottom of the connector body 1 or by molding the connector body 1 together with the arranged spring contacts 2. Because the number of the spring contacts 2 is relatively large and the size or the dimensions of the spring contacts 2 is relatively small, the above pressure fitting work or the integral molding process is not so easy in production processes.

To connect two circuit boards through the board connector, a first board A is inserted between the spring contacts 2 in card edge connection manner as shown. In this case, each contact 2 is brought into spring pressure contact with each printed contact area (not shown) formed in either side of the circuit board A. Further, a second board B is connected by soldering the end portion 2*a* of each spring contact 2 to each printed contact area (not shown) formed in either side of the circuit board $B_1$ or $B_2$. In this case, where the second board $B_1$ is arranged in parallel with the first board A, the end portion 25*a* of the spring contact 2 is bent at a right angle as shown. On the other hand, where the second board $B_2$ is arranged perpendicular to the first board A, the straight spring contact 2*b* is straight soldered to the second board $B_2$. Although not shown in FIG. 1, it is of course necessary to support the second board $B_1$ or $B_2$ by an appropriate supporting element to the board connector.

As understood by the above description, in the prior art board connector, the assembly work is rather complicated in assembling the board connector itself and the connecting work is also troublesome in connecting a first circuit board to a second circuit board through the board connector. In particular, when some circuit boards are connected in an automatic assembly process line on mass production scale, the prior art board connector does not necessarily agree with the automatic production system.

In view of the above description, reference is now made to a first embodiment of the circuit board connector according to the present invention.

Figure 2:
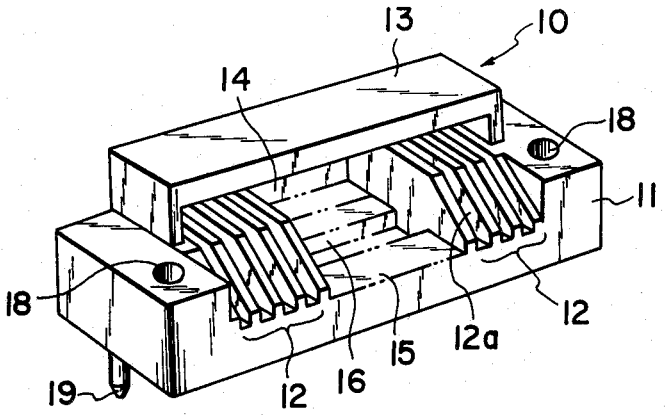
FIG. 2 is a perspective view of the printed circuit board connector according to the present invention, in which all spring contacts and some teeth of a comb portion are removed to facilitate understanding of the inner structure of the connector body.

FIG. 2 illustrates a connector body 10 made of a resin material by molding process, in which some teeth of a comb-shaped walls are removed for easy understanding of the inner structure thereof. The connector body 10 includes a base portion 11, a set of comb tooth shaped walls 12 for forming plural spring contact housing spaces 12*a*, a card edge connection portion 13 to form a groove thereunder, a first contact stopper wall 14, a second contact stopper wall 15, a first contact supporting wall 16, and a second contact supporting wall 17 (not shown in FIG. 2 but shown in FIG. 3). In the base portion 11, there are formed a pair of bolt holes 18 and a pair of locating pins 19.

Figure 3:
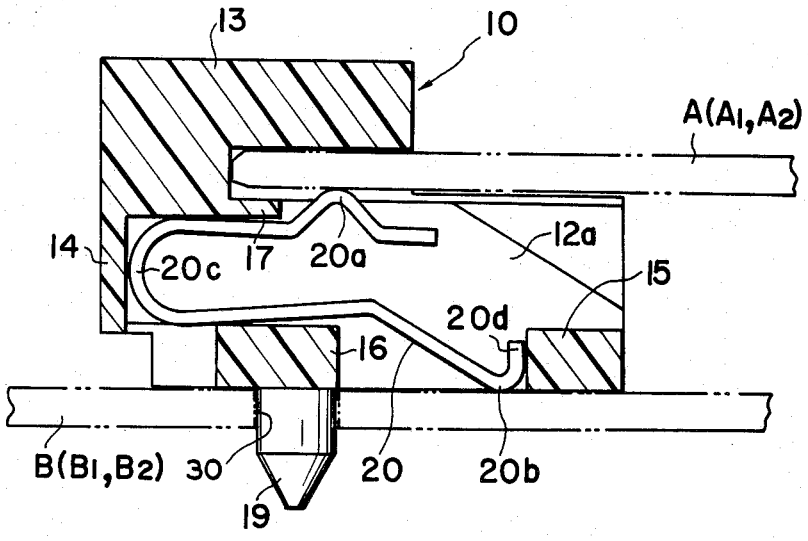
FIG. 3 is a diagrammatical cross-sectional view of a first embodiment of the board connector according to the present invention, by which a first circuit board is engaged with the board connector in card edge connection fashion and a second circuit board is engaged therewith in bolt-nut connection fashion.

With reference to FIG. 3, each roughly U-shaped spring contact 20 includes a round base portion 20*c*, a first arm portion with a first elastically bent contact portion 20*a*, and a second arm portion with a second elastically bent contact portion 20*b*.

A number of roughly U-shaped spring contacts 20 are inserted into each spring contact housing space 12*a* formed between two adjacent teeth of the comb-shaped walls 12 one by one or simultaneously by use of an appropriate jig. When inserted within the connector body 10, the round portion 20*c* thereof is loosely supported by the first stopper wall 14; one end portion 20*d* thereof is also loosely supported by the second stopper wall 15; and the two arm portions thereof are compressedly supported between the first and second support walls 16 and 17 near the round base portion 20*c* as depicted in FIG. 3. In other words, each spring contact 20 is housed within the spring contct housing partitions 12*a* in such a way as to be loosely supported by the two inner walls 14 and 15 in the longitudinal non-elastic direction thereof but compressed by supported by the other two inner walls 16 and 17 near the base thereof in the lateral direction thereof to allow two free ends of the spring contact to be brought into contact with the contact surfaces of two separate circuit boards, independently, when attached to the board connector.

With reference to FIG. 3, the method of using the board connector will be explained hereinbelow. A first printed circuit board A is inserted into a groove formed under the card edge connection portion 13, so that the first contact portion 20*a* of the spring contact 20 is brought into contact with an appropriate contact area (not shown) formed in the first board A. A second printed circuit board B is placed onto the surface of the base portion 11 with a guide hole 30 formed in the second board B engaged with the locating pin 19 and then securely fixed to the surface of the base portion 11 by use of a set of bolts passed through the bolt holes 18 and nuts (both not shown in both FIGS. 2 and 3), so that the second contact portion 20*b* of the spring contact 20 is brought into contact with an appropriate contact area (not shown) formed in the second board B.

In spite of a very simple construction such that spring contacts 20 are readily set within the connector body 10, the contact pressure can be adjusted by changing the dimensions of the spring contacts according to the kind of plating. For instance, when gold is plated onto the outer surface of the spring contact 20, since gold is hard, it is preferable to increase the contact pressure of the contacts 20 against the board. On the other hand, when tin is plated, since this material is relatively soft, it is preferable to decrease the contact pressure appropriately to change the contact pressure, the dimensions (length, width and thickness) of the spring contact 20 may be appropriately designed. However, it is the most desirable to adjust the contact pressure by changing only the length of the spring contact 20.

Figure 4:
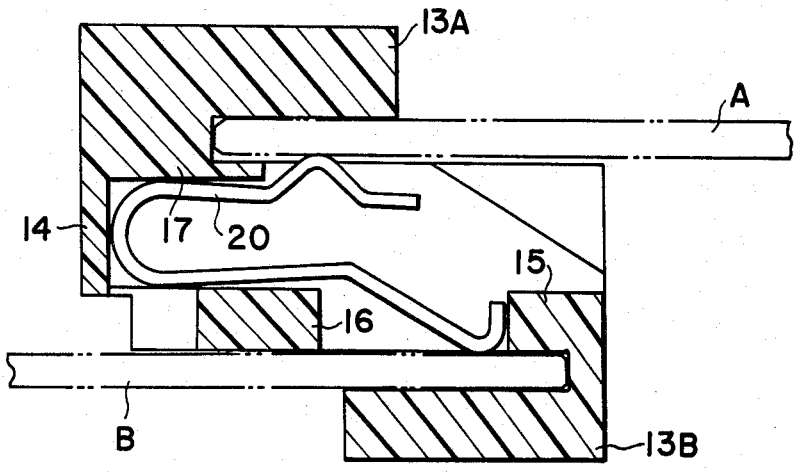
FIG. 4 is a diagrammatical cross-sectional view of a second embodiment of the board connector according to the present invention, by which two circuit boards are both engaged with the board connector in card edge connection fashion.

FIG. 4 illustrates a second embodiment of the printed circuit board connector according to the present invention. In this embodiment, the connector body 10 includes a first card edge connection portion 13A and a second card edge connection portion 13B instead of a pair of the bolt holes 18 and a pair of the locating pins 19. The structural features and functional effects of this embodiment other than those described above are substantially the same as with the first embodiment previously described and any detailed description of them may be unnecessary. The same references have been retained for similar parts or sections which have the same functions. In use, a first circuit board A and a second circuit board B are both connected to the board connector in card edge connection manner.

Further, in this embodiment, the two grooves into which two circuit boards A and B are inserted are formed in the connector body 10 in diametrically opposed relationship to each other. Therefore, two circuit boards A and B are connected to each other by the board connector in the opposite direction on both the sides of the connector. However, it is also possible to form the two grooves in the connector body 10 in parallel relationship between the two. In this case, two circuit boards A and B are connected to each other by the board connector in the same direction on one side of the connector.

Figure 5:
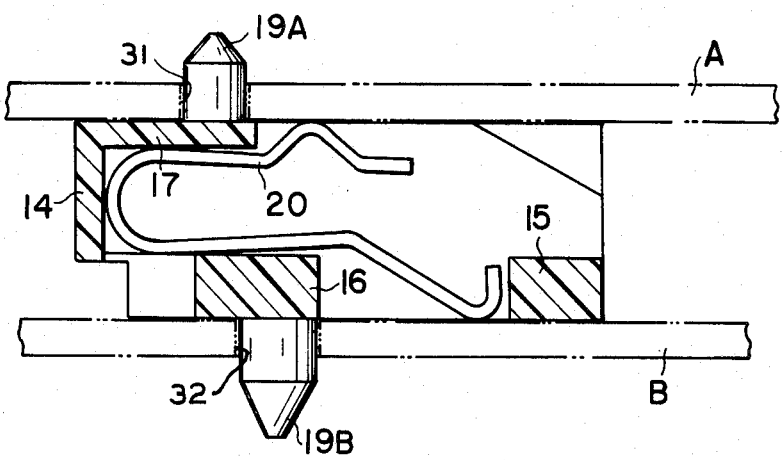
FIG. 5 is a diagrammatical cross-sectional view of a third embodiment of the board connector according to the present invention, by which two circuit boards are both engaged with the board connector in bolt-nut connection fashion.

FIG. 5 illustrates a third embodiment of the printed circuit board connector according to the present invention. In this embodiment, the connector body 10 includes two separate pair of the bolt holes (not shown) and two separate pair of locating pins on either side thereof instead of card edge connection portions. The same references have been retained for similar parts or sections which have the same functions. In use, a first circuit board A and a second circuit board B are both connected to the board connector in bolt-nut connection manner by engaging each locating pin 19A or 19B with each guide hole 31 or 32 formed in each circuit board A or B.

Figure 6:
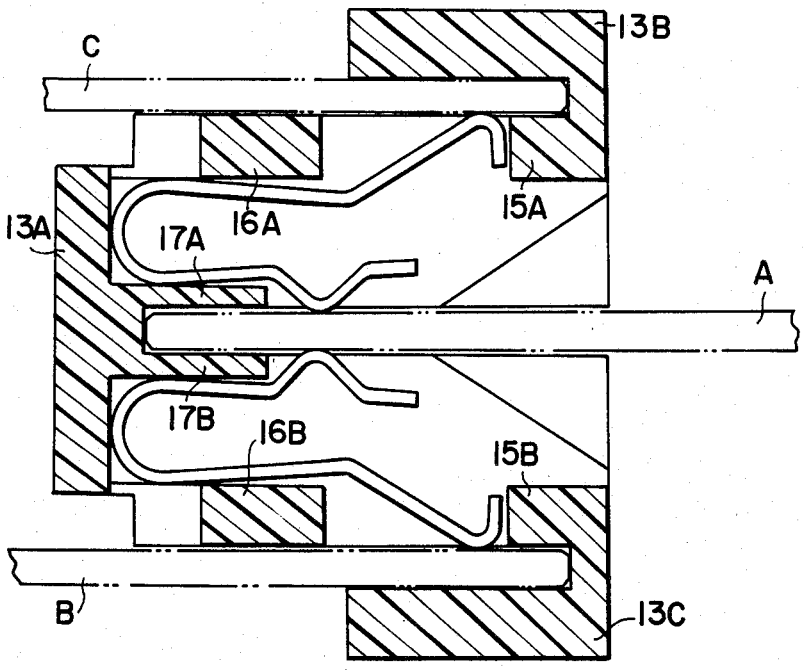
FIG. 6 is a diagrammatical cross-sectional view of a fourth embodiment of the board connector according to the present invention, by which three circuit boards are all engaged with the board connector in card edge connection fashion.

FIG. 6 illustrates a fourth embodiment of the printed circuit board connector according to the present invention. In this embodiment, the connector body 10 includes a first middle card edge connection portion 13A, a second upper card edge connection portion 13B and a third lower card edge connection portion **13*c*** without forming any bolt holes and locating pins. The same or similar references have been retained for similar parts or sections which have the same functions. In use, a first circuit board A is inserted into the middle groove in card edge connection manner. The other second and third circuit boards B and C are inserted into the upper and lower grooves also in card edge connection manner.

Further, in this embodiment, the first middle groove into which the first board A is inserted is formed in the connector body in diametrically opposed relationship to the other upper and lower grooves. Therefore, the first board A is connected to the other boards B and C in the opposite direction on both the sides of the connector. However, it is also possible to form the upper and lower grooves in the connector body 10 in parallel relationship to the middle groove. In this case, three circuit boards A and B are connected to each other by the board connector in the same direction on one side of the connector.

Further, in the above four embodiments, each circuit board A, B, or C is considered as a single board. However, it is also possible to divide the respective board A, B, or C into plural boards. In other words, in FIG. 3 for instance, two different boards $A_1$ and $A_2$ arranged in the same level are engageable with the connector on the same plane; or two different boards $B_1$ and $B_2$ arranged on the same level are engageable with the connector on the same plane.

As described above, in the printed circuit board connector according to the present invention, since the connector body is formed with the contact stopper walls and the contact support walls for holding each spring contact and further with at least one card edge connection portion or at least one pair of bolt holes and at least one pair of locating pins, it is possible to simply connect plural circuit boards through the board connector in card edge connection manner or bolt-nut connection manner in parallel or series relationship to each other. The above-mentioned feature allows the board connector according to the present invention to be efficiently applicable to an automatic mass-production assembly process line.

Further, since a number of spring contacts can easily be assembled within the connector body and held therewithin without need of any other elements, it is possible to simplify the assembling work of the board connector itself, thus economizing the manufacturing cost.

Furthermore, since the contact pressure against the circuit board to be connected can easily be adjusted easily by changing the length of the spring contact, it is possible to use any kinds of plating material for the spring contacts.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A printed circuit board connector for connecting at least two separate circuit boards, which comprises:

(a) a connector body having:

(1) a plurality of comb tooth shaped walls;

(2) a first contact stopper wall formed as a closed end wall of said connector body and a second contact stopper wall formed on one side and at an open end of said connector body;

(3) a first contact supporting wall formed on one side and near an intermediate portion of said connector body and a second contact supporting wall formed on the other side and near the intermediate portion of said connector body; and (b) a plurality of roughly U-shaped spring contacts having each a base portion, a first arm portion with a first elastically bent contact portion near a free end thereof and a second arm portion with a second elastically bent contact portion near a free end thereof, said spring contacts being each housed within a space formed between two adjacent comb tooth shaped walls in such a way as to be loosely supported between said first and second contact stopper walls in the longitudinal non-elastic direction thereof with the base portion thereof in contact with the first contact stopper wall and with the second elastically bent contact portion in contact with the second contact stopper wall and as to be compressedly supported by said first and second contact supporting walls near the base portion thereof in lateral elastic direction thereof with the first arm portion in contact with the first contact supporting wall and with the second arm portion in contact with the second contact supporting wall, the first and second elastically bent contact portions being each brought into contact with contact surfaces of two separate circuit boards, independently, when the circuit boards are attached to the board connector, separately.

2. The printed circuit board connector as set forth in claim 1 including the combination of three or more circuit boards through said connector.

3. The printed circuit board connector as set forth in claim 1, wherein said connector body is formed with at least one card edge connection portion for allowing at least one circuit board to be connectable to said board connector in card edge connection manner.

4. The printed circuit board connector as set forth in claim 1, wherein said connector body is formed with at least one pair of bolt holes and at least one pair of locating pins for allowing at least one circuit board to be connectable to said board connector in bolt-nut connection manner.

5. The printed circuit board connector as set forth in claim 1, wherein a length of said plural roughly U-shaped spring contacts is adjusted to obtain a required contact pressure against the circuit board to be connected.

* * * * *